US007601096B2

(12) United States Patent
Negrin

(10) Patent No.: US 7,601,096 B2
(45) Date of Patent: Oct. 13, 2009

(54) EXERCISE EQUIPMENT ABUSE PREVENTION CONTROL SYSTEM AND NETWORK EMPLOYING SAME

(76) Inventor: Barry E. Negrin, 300 E. 85th St. #206, New York, NY (US) 10028-4640

( * ) Notice: Subject to any disclaimer, the term of this patent is extended or adjusted under 35 U.S.C. 154(b) by 17 days.

(21) Appl. No.: 11/776,207

(22) Filed: Jul. 11, 2007

(65) Prior Publication Data

US 2008/0015087 A1 Jan. 17, 2008

Related U.S. Application Data

(60) Provisional application No. 60/830,176, filed on Jul. 12, 2006.

(51) Int. Cl.
*A63B 24/00* (2006.01)

(52) U.S. Cl. ..... 482/4; 482/8; 482/9

(58) Field of Classification Search ..... 482/1, 482/4, 8, 9, 901–902
See application file for complete search history.

(56) References Cited

U.S. PATENT DOCUMENTS 5,478,295 A * 12/1995 Fracchia ..... 482/7
5,890,997 A * 4/1999 Roth ..... 482/8
6,971,973 B2 * 12/2005 Cohen et al. ..... 482/8
7,128,693 B2 * 10/2006 Brown et al. ..... 482/8
2006/0046898 A1 * 3/2006 Harvey ..... 482/8
2006/0058156 A1 * 3/2006 Cohen et al. ..... 482/4
2006/0223674 A1 * 10/2006 Korkie ..... 482/8
2007/0032345 A1 * 2/2007 Padmanabhan et al. ..... 482/8
2007/0033069 A1 * 2/2007 Rao et al. ..... 705/2

* cited by examiner

*Primary Examiner*—Fenn C Mathew
*Assistant Examiner*—Andrew M Tecco
(74) *Attorney, Agent, or Firm*—Pryor Cashman LLP; Barry E. Negrin, Esq.

(57) ABSTRACT

An exercise device abuse-prevention control system is provided to help prevent users of community or shared exercise equipment from spending too much time on the equipment and not allowing other users to use and enjoy the equipment. The control system includes an external variable indicator measuring at least one external variable not dependent on a given user's physiology, e.g., the time of day or the number of machines in use at once. A timer measures a duration of the user's workout, and a timer limiter is provided and is presettable by an administrator to delineate a maximum workout duration when the at least one external variable reaches a predetermined threshold. When the external variable indicator measures the at least one external variable to be reached or exceeded, the timer limiter prevents the user's workout from exceeding the maximum duration.

21 Claims, 6 Drawing Sheets

EXERCISE EQUIPMENT ABUSE PREVENTION CONTROL SYSTEM AND NETWORK EMPLOYING SAME

RELATED APPLICATION

Domestic priority is claimed from U.S. provisional patent application No. 60/830,176, filed Jul. 12, 2006, entitled "Exercise Equipment Abuse Prevention Control System and Network Employing Same".

BACKGROUND OF THE INVENTION

1. Field of the Invention

The invention relates to exercise equipment, and more specifically to control systems for exercise equipment designed to prevent abuse of the equipment.

2. Description of the Related Art

Physical fitness is extremely important to a growing segment of the population. With an ever-increasing number of overweight and obese people worldwide, the number of facilities such as fitness centers is also increasing, as is the number of clientele each center services. Each fitness center, however, has a finite amount of space and can thus accommodate a finite amount of exercise equipment. Nonetheless, a typical fitness center constantly seeks to bring in new members, despite that the number of machines it can offer its members is constrained by its physical premises.

One problem arising out of this situation is the abuse of machinery in a fitness center. Because there are, in many instances, more members in a given fitness center than exercise machines, it is a common occurrence that all of the machines are in use and excess or additional members must stand around in line waiting for machines to use. Rather than cap the number of members it may have (which would mean capping its source of revenue), a fitness center may limit the amount of time a member may spend on a given machine during a workout. This is usually intended to be achieved by the posting of a sign near the fitness equipment reading "please limit your workout to 30 minutes during peak hours", or words to that effect. However, people being people, these signs often go unheeded, with members using a machine for far longer than the prescribed posted period. This prevents other members from using the equipment, and may encourage altercations between members waiting for machines and the selfish members who abuse their privileges under crowded conditions.

Apart from the posting of a sign, there are no known effective solutions to this problem. A fitness center might employ a staff person to enforce the time limit policy, however this too is of limited help. For one, the enforcing staff member will likely cause some degree of tension between the center and the selfish member. For another, the fitness center is forced to pay for an employee to carry out this function or use its existing staff to perform this function; either way, such centers do not seek to increase their overhead when it can be helped nor seek to cause strife between their staff and their membership. Accordingly, there is a long-felt need to develop a low-cost or cost-free system of preventing abuse of exercise equipment in a fitness center or similar setting where there are potentially more users of equipment than pieces of equipment.

SUMMARY OF THE INVENTION

The invention is an abuse-preventing control system resident on or in communication with exercise equipment. Generally speaking, the exercise equipment is provided with the inventive control system for preventing a single use to exceed a pre-selectable time limit under predeterminable conditions. One such condition is the time of day, since many exercise facilities have peak times of use, typically before the normal workday (e.g., 6-8 am), immediately after work (e.g., 5-8 pm), and possibly during the lunch hour (e.g., 12-2 pm). Thus, if the fitness center typically experiences a rush of members during the same times of day every day, the control system can be set by a center administrator to prevent a machine from running for more than 30 minutes consecutively during such peak hours.

Another such condition is the number of similar machines in use at the time, or the current load on a bank of machines. Thus, if there are eight treadmill machines and all eight are in use, the control system will limit the use of any of the treadmills to a predetermined time period such as 20-30 minutes. This condition can be used in conjunction with the time-of-day condition, wherein if the time of day corresponds to a peak period but there are fewer than a predetermined number of machines in use, the control system will not limit the use of the machines until that predetermined number of machines in use is reached. Alternatively, the control system can be set to limit workouts under either time-of-day or peak load conditions. The predetermined peak load number need not be all of a given bank of machines; it may be settable to a threshold below the maximum number of machines present in the facility. Exercise machines employing the inventive control system may be networked together for the purpose of automatically determining how many are in use at a given time.

The administrator may enter the predeterminable variables by one or more of several means. Many exercise devices have integral keypads or control panels for use by the users of the equipment. A certain predetermined set of keystrokes or multiple keys being pushed simultaneously may change the device from a normal use mode to an administrative mode. Alternatively, a slot may be provided for a physical key device which, when inserted, enables operation of the administrative mode. As another alternative, a wireless remote control may be provided and employed. By entering a certain sequence of buttons presses or by use of a physical or wireless key, a facility administrator can set a maximum period for which one usage of the device can be employed or set, and can set the time periods or load usages during which the maximum period will be enforced.

Optionally, one or more warning messages may be provided or enterable into the system to let the user know at the beginning of her workout that she is being limited to a time-restricted session. Warning messages may be provided during the workout session should load usage change or should the time of day change from a non-peak period to a peak period. It may be left up to the administrator whether to have the control system truncate a workout that is longer than the preset maximum workout duration that began during a non-peak time but extends into a peak time (or began under non-peak load conditions and extended into peak load conditions). That is, the control system may periodically or continuously check its external variable even during existing workouts to see if the predetermined variable threshold has been reached or exceeded and, should the threshold have been exceeded, terminate the workout or truncate it appropriately. Additionally, warning messages may be provided that let at least one of the user and a third party know when her session is about to end. The third party may be the fitness center administrator or another member waiting for the equipment, and the messages may be displayed on the machine's display panel (e.g., for the current user), an overhead light or display (e.g., for the benefit of the waiting member), and/or a remote computer display (e.g., for the administrator).

The invention is also adaptable for limiting the number of repetitions of movement a user has on a device. So, for example, an administrator may set an upper limit of 10-15 'reps' per machine in a circuit training environment to insure that users of the circuit training machines do not take too long on one or more machines so that other users may also enjoy use of the circuit machines.

More specifically, the invention is an exercise equipment abuse prevention control system. The inventive control system includes an external variable indicator measuring at least one external variable, e.g., a variable not dependent on a given user's physiology. A timer is preferably provided settable by a user of the exercise device which delineates a duration of the user's workout. The control system also includes a timer limiter presettable by an administrator that delineates a maximum workout duration settable on the timer when the at least one external variable reaches a predetermined threshold. When the external variable indicator measures that the at least one external variable has reached or exceeded the predetermined threshold, the timer limiter prevents the user from entering a workout duration greater than the maximum duration. Alternatively, the timer limiter prevents the user's workout from exceeding the maximum duration regardless of what is entered by the user.

In one embodiment, the exercise machine will simply stop working for a reset or refractory period and/or until its moving parts (e.g., the treadmill) come to a complete stop. This prevents or discourages the current user from ending one allowed period of exercise and immediately thereafter beginning another, to the detriment of waiting members. Alternatively or in addition, a public display (e.g., an overhead light, a bank of LEDs reading out the current time left in the workout, or even a simple light) indicates that the current workout is exceeding the allowed time period and/or that the machine is now available.

Preferably, the external variable indicator measures at least one of time of day or load usage of multiple exercise machines as its external variable. If the external variable indicator is measuring time of day, then the external variable indicator includes a clock measuring the time of day, and the predetermined threshold includes a settable time period, e.g., a peak time period. If, instead or in addition, the external variable indicator is measuring load usage of multiple exercise machines, then the external variable indicator includes a load detector detecting a load of how many of a given bank of exercise machines are in use at a given time, and the predetermined threshold is a number of the exercise machines, e.g., all of them, all of them minus one, or the like. The control system is preferably resident on a CPU of one or more exercise devices. In addition or in the alternative, a plurality of exercise devices are networked and the control system resides on a CPU remote from but in communication with the plurality of exercise devices.

In one embodiment, the predetermined threshold may include a secondary threshold. The secondary threshold may include a secondary settable time period, the timer limiter being presettable by the administrator delineating a secondary maximum workout duration settable on the timer when the time of day measured on the clock reaches the secondary settable time period. For example, while a peak hour (e.g., 6-8 am or 12-2 pm) maximum workout might be limited to 20 or 30 minutes, a secondary time period (e.g., 7-9 pm) might be set by the administrator to have workouts limited to 45-60 minutes. Alternatively, the secondary time period may be treated as merely another peak time period, and the maximum duration may be the same for all predetermined thresholds.

As another alternative, the predetermined threshold may include a secondary number of exercise machines in use, the timer limiter being presettable by the administrator to delineate a secondary maximum workout duration settable on the timer when the load detected on the load detector reaches the secondary number. For example, if a bank of machines has six machines, the primary load threshold may be all six machines in use at once. During such primary or peak load conditions, the user workouts may be limited to 20-30 minutes, as an example. However, under secondary load conditions, e.g., four or five machines in use at once, the user workouts may be limited to the secondary, somewhat less restrictive durations of 45-60 minutes, for example.

In all of the above embodiments, it is preferred that the predetermined threshold is settable by the administrator of the facility, e.g., the fitness center manager. It is also preferred that the access to setting the predetermined threshold(s) be restricted by an access restriction device, e.g., by one or more of a physical key, a magnetic card key, a passcode enterable on the control panel of the exercise device, a remote control device such as an infra-red or RF controller, or the like. The control system may be provided with default timer limiter settings and/or default predetermined threshold(s) for the measured external variables.

In another embodiment, the inventive exercise device abuse-prevention control system includes an external variable indicator measuring at least one external variable and a timer measuring a duration of the user's workout. A timer limiter is provided which an administrator may preset to delineate a maximum workout duration when the at least one external variable reaches a predetermined threshold. When the external variable indicator measures the at least one external variable to be reached or exceeded, the timer limiter prevents the user's workout from exceeding the maximum duration, and the workout session is terminated.

Alternatively or in addition, an external display notifies a third party (e.g., the center administrator, a waiting member) that the workout is exceeding the allowed time period. In terminating the workout session, the exercise machine may simply stop working for a reset or refractory period and/or until its moving parts (e.g., the treadmill) come to a complete stop. This prevents or discourages the current user from ending one allowed period of exercise and immediately thereafter beginning another, to the detriment of waiting members. Alternatively or in addition, a public display (e.g., an overhead light, a bank of LEDs reading out the current time left in the workout, or even a simple light) indicates that the current workout is exceeding the allowed time period and/or that the machine is now available.

DETAILED DESCRIPTION OF THE PREFERRED EMBODIMENTS AND DRAWINGS

Description will now be given of the invention with reference to FIGS. 1-3B. It should be noted that these drawings are exemplary in nature and do not serve to limit the scope of the invention, which is defined by the claims appearing hereinbelow.

Figure 1:
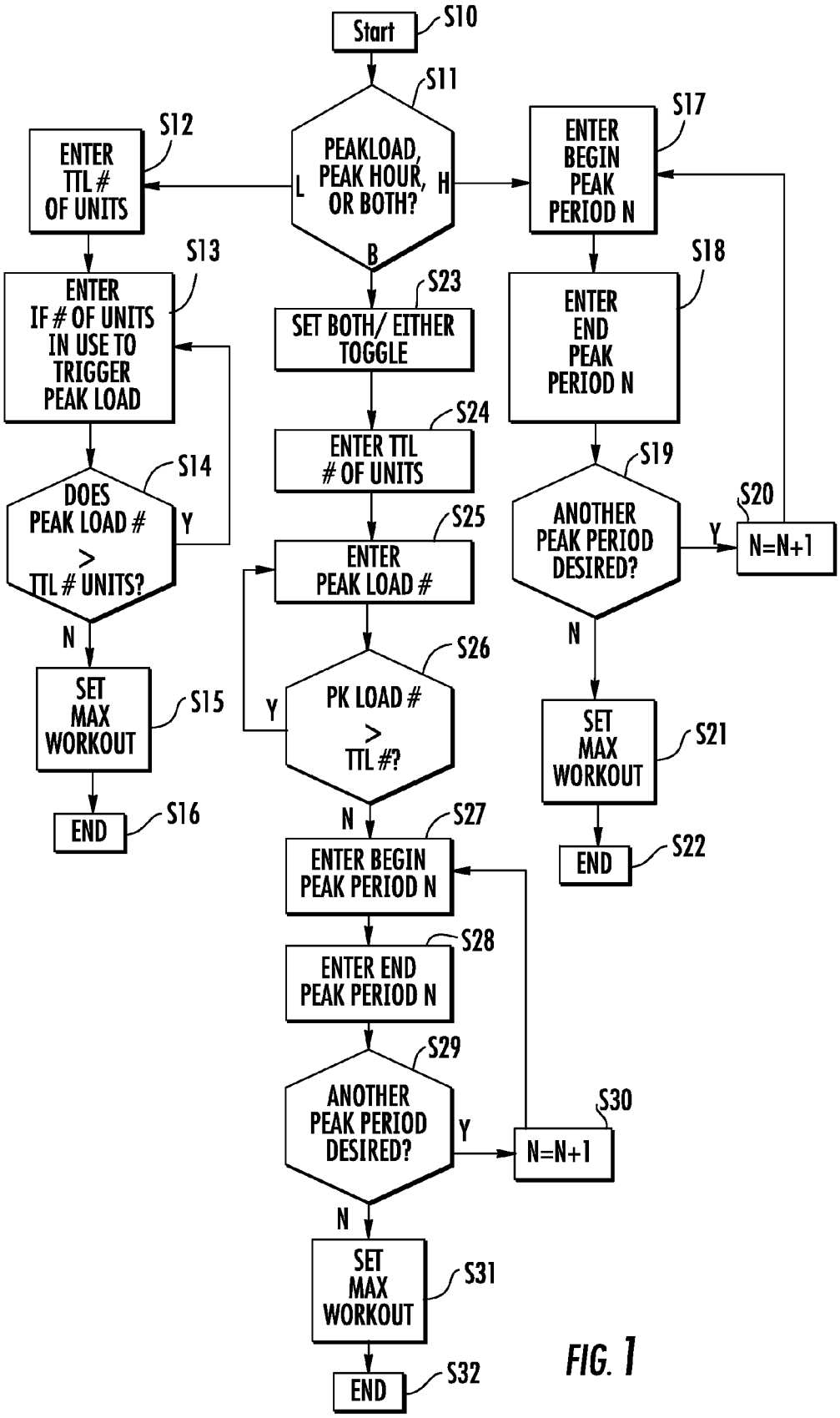
FIG. 1 is a flow chart depicting one embodiment of an administrative setup mode of a control system in accordance with the invention.

FIG. 1 is a flow chart depicting one embodiment of an administrative setup mode of the inventive exercise device control system. In this mode, the fitness center manager or administrator programs the exercise equipment, either one by one or from a central location such as a remote CPU or computer. The administrator may enter the setup mode in any number of ways, such as via a physical key, an electronic (magnetic) key card, by pressing a specific sequence of buttons on the exercise device control pad (or multiple buttons at once, similar to the Control-Alt-Delete key command on a personal computer), or by a remote control device such as an infrared or radio frequency controller, or by the keyboard of a central computer, or the like.

However the administrator gains access to the setup mode, the setup mode begins in FIG. 1 at step S10. In step S11, the control system queries the administrator as to how she desires to control the workout durations, via peak load (number of machines in use), via peak hour, or both. If the administrator selects the peak load option, the control system moves to step S12, in which the administrator is asked to enter the total number of units in a given bank of machines. Optionally, the control system is able to detect the presence of the machines in a network, e.g., via a query and response, and this step may be automatically performed by the system. The administrator is then prompted to enter the number of units needed to be in use simultaneously to define peak load. At step S14, the system compares the number entered by the administrator to the total number of units to ensure that the peak load number does not exceed the total number. If the peak load number exceeds the total number, the logic flow returns to step S13 and the administrator is asked to re-enter the peak load number. If the peak load number does not exceed the total number, then the administrator is asked to set the maximum allowed duration of user workouts (e.g., in minutes) at step S15. After that number has been entered, the logic flow ends at step S16, whereupon the system may provide the administrator with a message indicating successful programming of the system, optionally including a summary of the information entered (e.g., peak load and maximum workout duration).

If, in step S11, the administrator selects the peak hour option, the control system moves to step S17, in which the administrator is asked to enter the time at which the peak period or hour is to begin. (Step S17 refers to "peak period N" which will be discussed below.) The administrator is then asked to enter the time at which the peak period is to end at step S18. At step S19, the administrator is asked if a second peak period is desired by the administrator. In this way, the administrator may create multiple peak periods, such as an early morning pre-work period, a lunch hour period, and/or an evening post-work period. If another period is desired by the administrator, the logic increments the number designation for the given peak period at step S20 (N=N+1) and returns to step S17 to ask for the beginning of the next peak period. When the administrator is finished entering the beginning and ending times of all the peak periods she desires to set and selects "no" at step S19, the logic flow proceeds to step S21 where the administrator is asked to set the maximum allowed duration of user workouts. After that number has been entered, the logic flow ends at step S22, whereupon the system may provide the administrator with a message indicating successful programming of the system, optionally including a summary of the information entered (e.g., peak periods and maximum workout duration).

Finally, if the administrator selects the "both" option in step S11, the control system moves to step S23, where she is asked to set the both/either toggle which determines if only one peak condition need occur to define a peak situation or if both are required. Thus, if the "both" setting is selected, then for a peak condition to occur, the requisite number of machines must be in use during the requisite time of day. This is the least restrictive option on members' workouts. If instead the "either" setting is selected, then a peak condition will occur during peak hours or when the requisite number of machines are in use (regardless of time of day).

In either case, the logic flow of steps S24-32 is very similar to that of steps S12-22 and will be discussed briefly. The total number of units is entered at step S24 (or is automatically determined by the system), and the peak load number of units is entered at step S25. The system ensures that the peak load number is not greater than the total number of machines in step S26. The beginning time of peak period N is entered at step S27, and the ending time is entered at step S28. If another peak period is desired at step S29, the logic increments the number designation for the given peak period at step S30 (N=N+1) and returns to step S27 to ask for the beginning of the next peak period. When the administrator is finished entering the beginning and ending times of all the peak periods she desires to set and selects "no" at step S29, the logic flow proceeds to step S31 where the administrator is asked to set the maximum allowed duration of user workouts. After that number has been entered, the logic flow ends at step S32, whereupon the system may provide the administrator with a message indicating successful programming of the system, optionally including a summary of the information entered (e.g., peak periods, peak loads, and maximum workout duration).

Optionally, each peak period may be provided with a different maximum workout duration. In such a case, the positions of steps S19 and S21 would be reversed, or if "both" were selected, steps S29 and S31 would be reversed. In either case, each peak period N would have its own settable maximum workout duration. After each period's maximum workout duration is set, then the system would query whether another peak period is desired, and if so, the process returns to step S17 or step S27.

Figure 2A:
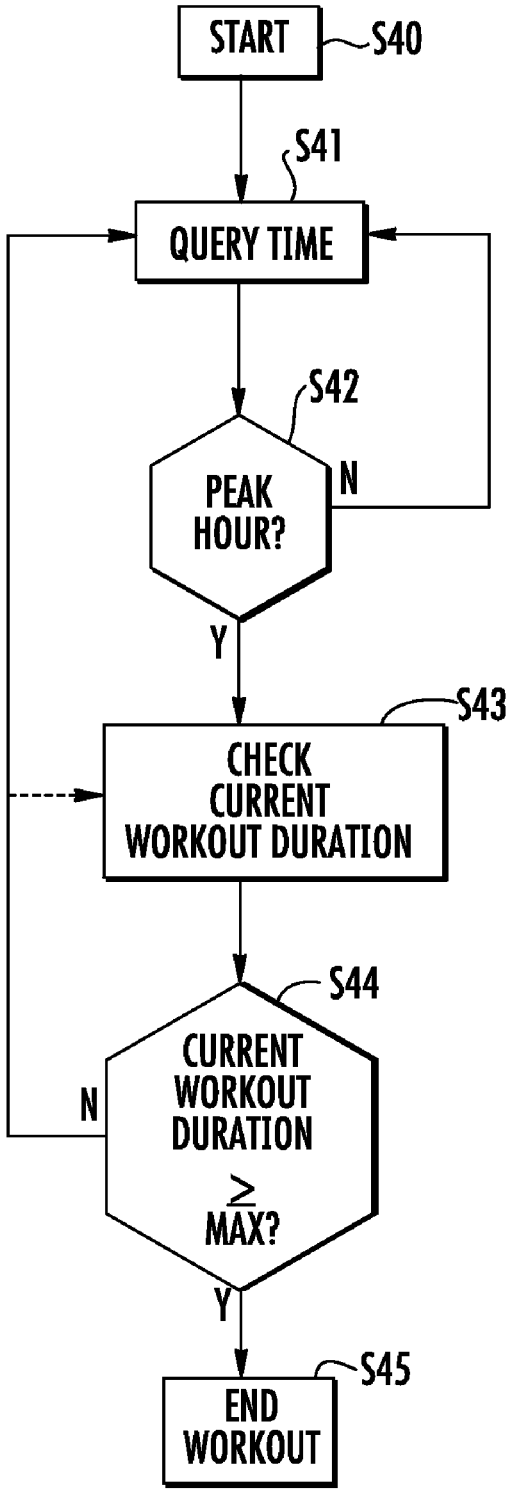
FIG. 2A is a flow chart depicting one embodiment of a control system in accordance with the invention.

FIG. 2A is a flow chart depicting one embodiment of how the inventive control system serves to limit the workout of a user based on what time of day it is. The system begins at step S40 and determines what time it is currently at step S41. The exercise device or inventive control system resident thereon are preferably provided with a clock for such purposes. Alternatively, time signals can be received externally, e.g., wirelessly (as with the time signal on a cell phone) or via signals sent through the power supply. In any event, the time detected is compared at step S42 to the one or more peak hour periods set by the administrator. If it is currently not a peak hour, the logic returns to step S41 and checks the time again. The return to step S41 may occur continuously or it may occur periodically, e.g., once per minute.

If it is currently a peak hour, the control system checks the current workout duration at step S43. The system compares the current workout duration to the preset maximum workout duration at step S44. If the current workout duration is less than the preset maximum, then the logic returns to step S41 to determine what time it is or, optionally, returns to step S43 to determine how long the current workout is now. If the current workout duration equals or exceeds the preset maximum at step S44, then the system ends the current user's workout at step S45. At that point, the system may provide a message to the user explaining that workouts are limited to the preset maximum during peak hours. Alternatively or in addition, a public display (e.g., an overhead light, a bank of LEDs reading out the current time left in the workout, or even a simple light) indicates that the current workout is exceeding the allowed time period and/or that the machine is now available. Warning messages may be provided that let at least one of the user and a third party know when her session is about to end. The third party may be the fitness center administrator or another member waiting for the equipment, and the messages may be displayed on the machine's display panel (e.g., for the current user), an overhead light or display (e.g., for the benefit of the waiting member), and/or a remote computer display (e.g., for the administrator).

Figure 2B:
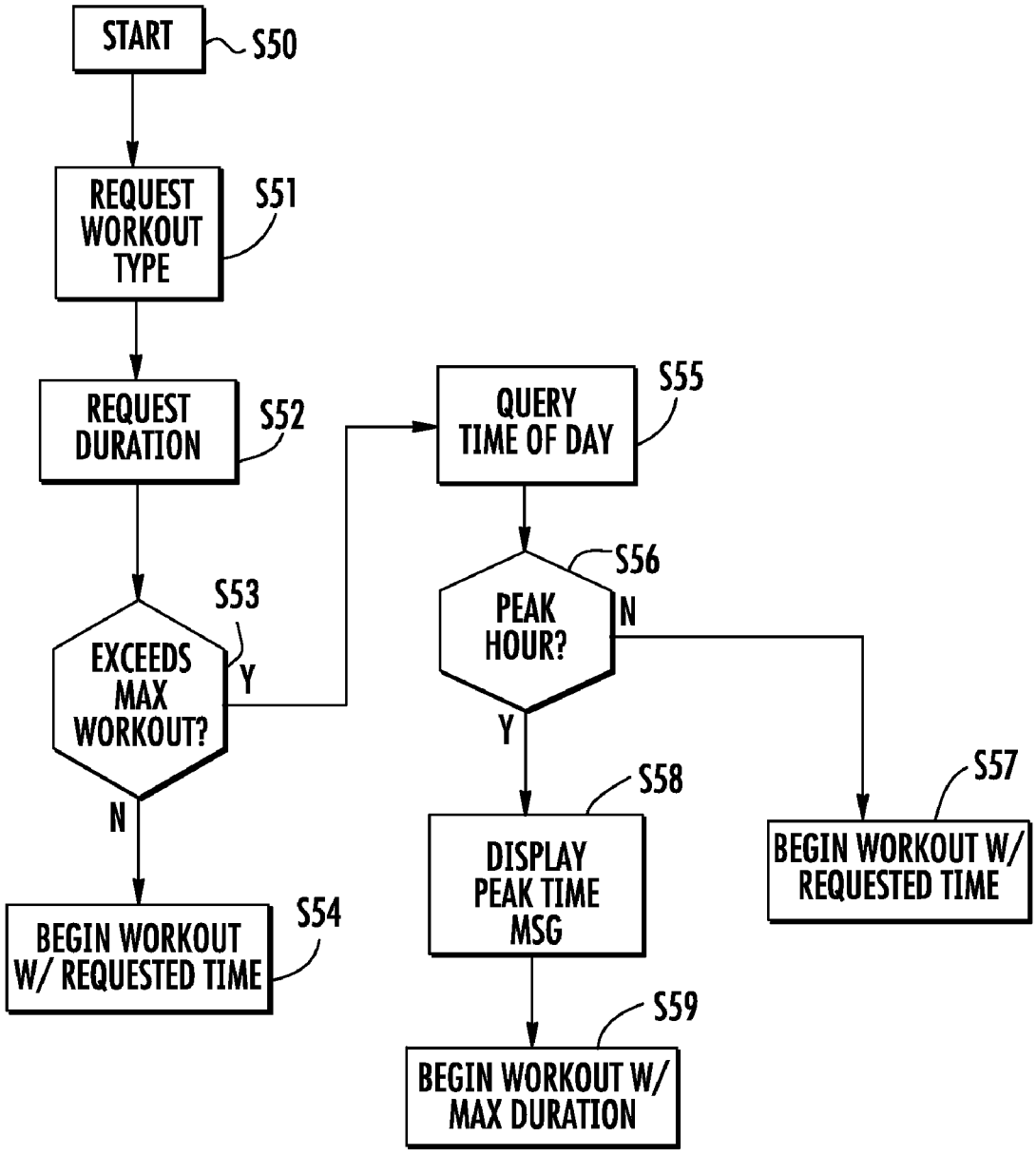
FIG. 2B is a flow chart depicting one embodiment of an end user mode of a control system in accordance with the invention.

Some exercise machines ask the user at the onset of the workout how long they intend to use the machine during a given session. For such machines, FIG. 2B is a flow chart depicting one embodiment of how the inventive control system serves to limit the workout of a user based on what time of day it is. The control system begins at step S50. Optionally, the machine may ask the user what type of workout he is interested in (e.g., heart-healthy, fat-burning, strength training, manual, etc.) at step S51. The duration of the desired workout is requested at step S52 and compared to the preset maximum workout at step S53. If the requested workout duration does not exceed the preset maximum, the workout commences as requested at step S54. If the requested workout duration does exceed the preset maximum, then the system determines the time of day at step S55. If the present time of day is determined at step S56 not to be during a peak hour, then the workout is begun with the requested duration at step S57. If the time is during a peak hour, then a message informing the user that it is currently a peak hour is displayed at step S58, and the workout is begun at step S59 with only the preset maximum allowed workout duration.

Figure 3A:
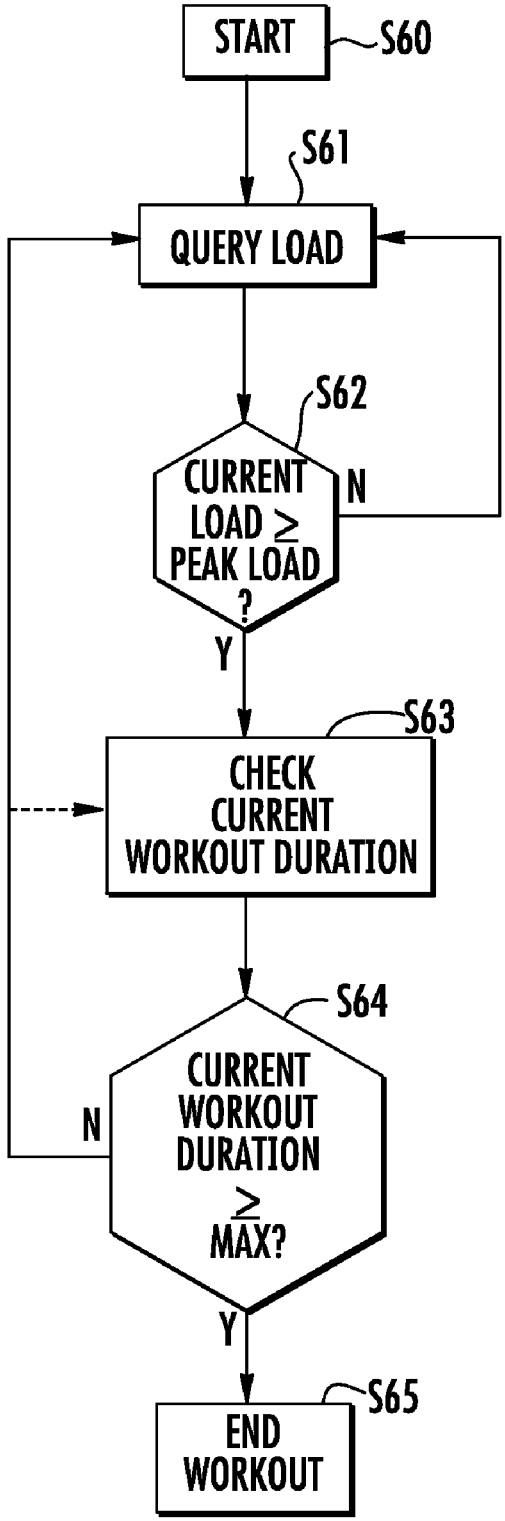
FIG. 3A is a flow chart depicting another embodiment of a control system in accordance with the invention.
Figure 3B:
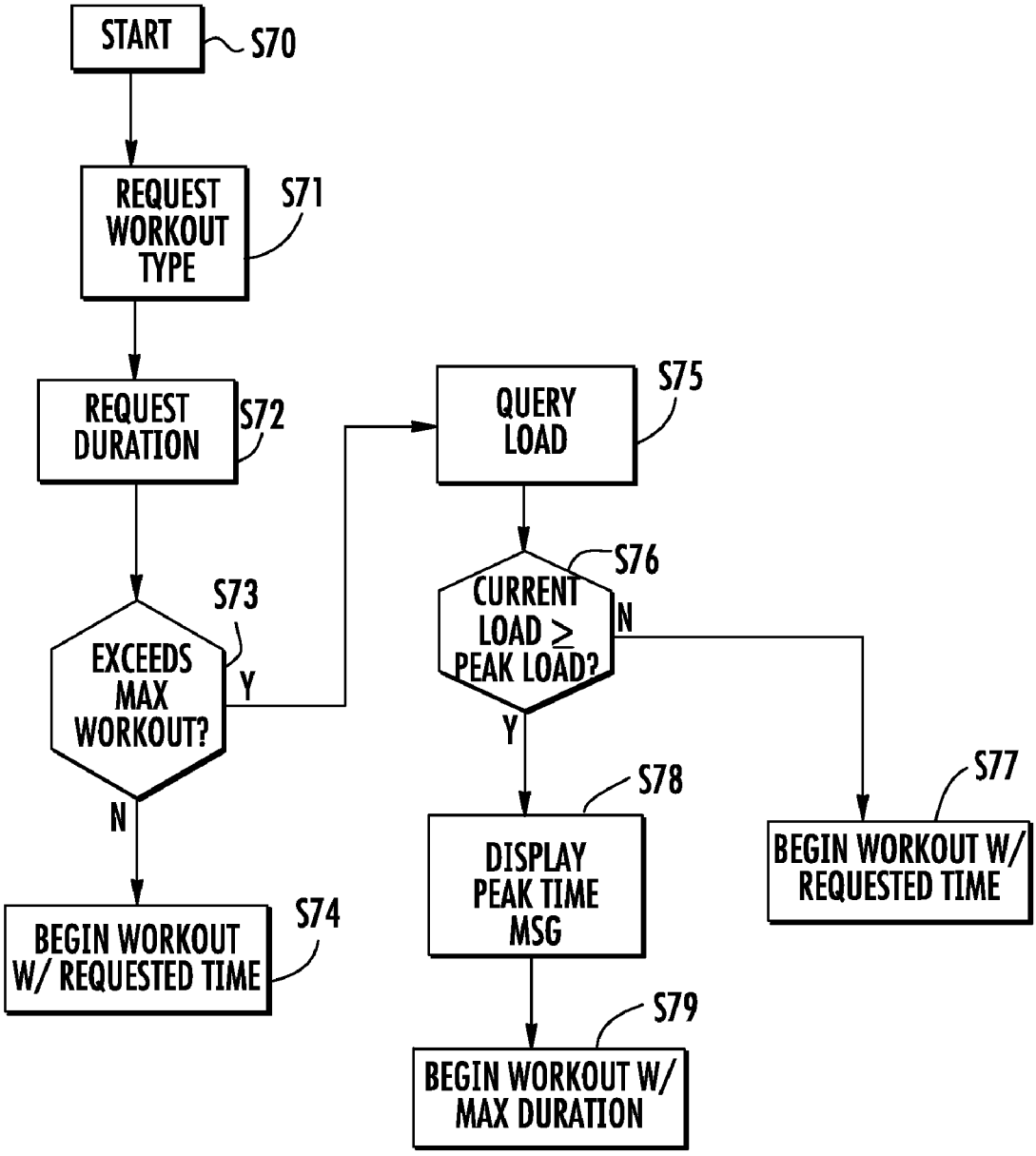
FIG. 3B is a flow chart depicting another embodiment of an end user mode of a control system in accordance with the invention.
Figure 4:
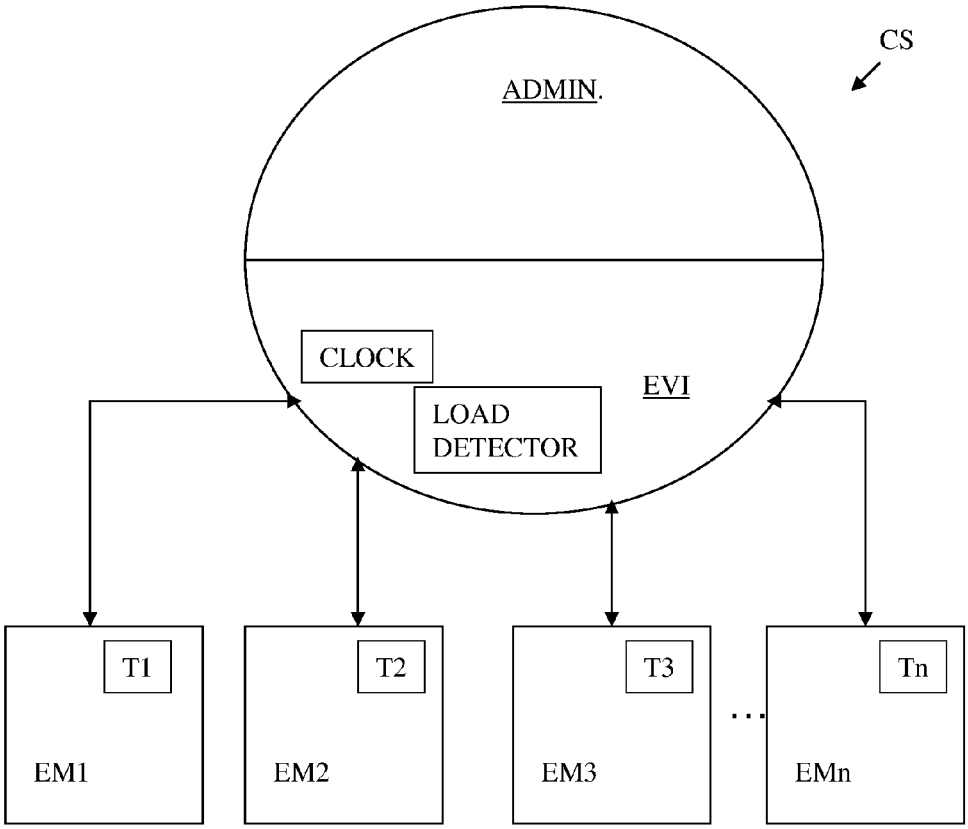
FIG. 4 is an overall schematic of one embodiment of the control system CS of the invention, showing a number of networked exercise machines EM1 through n each including a timer T1 through n, an external variable indicator having at least one of a clock or a load detector, and an administrator ADMIN.

FIGS. 3A-B are similar to FIGS. 2A-2B but instead describe how the inventive control system limits a user's workout depending on the number of machines in use (the load).

FIG. 3A is a flow chart depicting one embodiment of how the inventive control system serves to limit the workout of a user based on the number of machines currently in use. Starting at step S60, the system queries the current load of machines at step S61. In such a system, the exercise machines are networked together and provide an "in use" signal when being used. The control system determines if the current load is equal to or greater than the peak load at step S62. If not, then the system cycles back to step S61 and queries current load anew. This cycling to determine current load may be continuous or may be periodic, e.g., once per minute. In either case, if the system determines that the current load is equal to or greater than the preselected peak load, then the current duration of the instant workout is checked at step S63 and compared to the preset maximum workout at step S64. If the current workout duration is greater than or equal to the maximum workout duration, then the system ends the workout at step S65, optionally providing an appropriate message to the user. If the current workout duration is less than the maximum workout duration, then the system returns to step S61 to re-query the current load or, optionally, to step S63 to re-query the current workout duration.

As with FIG. 2B, FIG. 3B is a flow chart depicting one embodiment of how the inventive control system serves to limit the workout of a user based on current load for those types of machines that ask the user at the onset of the workout how long they intend to use the machine during a given session. The control system begins at step S70. Optionally, the machine may ask the user what type of workout he is interested in (e.g., heart-healthy, fat-burning, strength training, manual, etc.) at step S71. The duration of the desired workout is requested at step S72 and compared to the preset maximum workout at step S73. If the requested workout duration does not exceed the preset maximum, the workout commences as requested at step S74. If the requested workout duration does exceed the preset maximum, then the system determines the current load of usage at step S75 If the current load is determined at step S76 to be less than peak load, then the workout is begun with the requested duration at step S77. If the current load is equal to or greater than the peak load, then a message informing the user that it is currently a peak load condition is preferably displayed at step S78, and the workout is begun at step S79 with only the preset maximum allowed workout duration.

The invention is not limited to the above description. For example, in the situations where the administrator chooses to regulate user workouts based on both time of day and load conditions, the control system would perform a combination of the logic shown in FIGS. 2A and 3A and/or that shown in FIGS. 2B and 3B. Further, the system may be provided with a manual override function so that if a preset condition is being met (e.g., it is 7:00 am) but no one is waiting for a machine and/or no one is complaining, the administrator can override the control system and allow more lengthy workouts without having to reset the system. Similarly, the system may be provided with a simple "on" button or function that activates the control system without requiring any administrative setup. In such embodiments, the control system may be provided with preset default values for peak time periods and peak workout durations, as well as requiring all detected machines in a given network to be in use to activate the peak load condition. Also, the inventive control system may provide for an adequate cool down period (e.g., 30 seconds to a few minutes, optionally also pre-settable by the administrator) before either terminating the workout or notifying a third party that the machine is becoming available.

Having described certain embodiments of the invention, it should be understood that the invention is not limited to the above description or the attached exemplary drawings. Rather, the scope of the invention is defined by the claims appearing hereinbelow and any equivalents thereof as would be appreciated by one of ordinary skill in the art.

What is claimed is:

1. An exercise device abuse-prevention control system, comprising:

an external variable indicator measuring at least one external variable not dependent on a given user's physiology;

a timer measuring a duration of the user's workout;

a timer limiter presettable by an administrator delineating a maximum workout duration when said at least one external variable reaches a settable predetermined threshold only settable by an administrator, wherein when said external variable indicator measures the at least one external variable to be reached or exceeded, said timer limiter prevents the user's workout from exceeding said maximum duration, and wherein said external variable indicator measures at least a load of how many of a given bank of exercise machines are in use at a given time, with said settable predetermined threshold including a number of the exercise machines in the given bank.

2. An exercise device abuse-prevention control system according to claim 1, wherein said external variable indicator further comprises a clock measuring the time of day and said predetermined threshold further comprises a settable time period.

3. An exercise device abuse-prevention control system according to claim 1, wherein said control system is resident on a CPU of one or more exercise devices.

4. An exercise device abuse-prevention control system according to claim 2, said predetermined threshold further comprising a secondary settable time period, said timer limiter being presettable by the administrator delineating a secondary maximum workout duration allowable when the time of day measured on said clock reaches said secondary settable time period.

5. An exercise device abuse-prevention control system according to claim 1, said predetermined threshold further comprising a secondary number of exercise machines in use, said timer limiter being presettable by the administrator delineating a secondary maximum workout duration allowable when the load detected on said load detector reaches said secondary number.

6. An exercise device abuse-prevention control system according to claim 1, wherein access to setting the predetermined threshold is restricted by an access restriction device.

7. An exercise device abuse-prevention control system according to claim 6, wherein said access restriction device comprises at least one of a physical key, a magnetic card key, a passcode enterable on the control panel of the exercise device, a wireless remote control device, or a password on a computer.

8. An exercise device abuse-prevention control system according to claim 1, wherein a plurality of exercise devices are networked, and said control system resides on a CPU remote from but in communication with the plurality of exercise devices.

9. An exercise device abuse-prevention control system according to claim 1, further comprising a warning message generator to inform at least one of i) a user during a workout session or ii) a third party when said predetermined threshold is reached or exceeded.

10. An exercise device abuse-prevention control system according to claim 1, wherein said external variable indicator periodically measures the external variable during existing workouts to determine if the predetermined threshold has been reached or exceeded.

11. An exercise device abuse-prevention control system according to claim 10, wherein when said external variable indicator determines that said predetermined threshold is reached or exceeded during a workout, said control system terminates the workout.

12. An exercise device abuse-prevention control system, comprising:

an external variable indicator measuring at least one external variable;

a timer settable by a user of the exercise device delineating a duration of the user's workout;

a timer limiter presettable by an administrator delineating a maximum workout duration settable on said timer when said at least one external variable reaches a settable predetermined threshold only settable by an administrator, wherein when said external variable indicator measures the at least one external variable to have reached or exceeded said predetermined threshold, said timer limiter prevents the user from entering a workout duration greater than said maximum duration, and wherein said external variable indicator measures at least a load of how many of a given bank of exercise machines are in use at a given time, with said settable predetermined threshold including a number of the exercise machines in the given bank.

13. An exercise device abuse-prevention control system according to claim 12, wherein said external variable is not dependent on a given user's physiology.

14. An exercise device abuse-prevention control system according to claim 12, wherein said external variable indicator further comprises a clock measuring the time of day and said predetermined threshold further comprises a settable time period.

15. An exercise device abuse-prevention control system according to claim 12, wherein said control system is resident on a CPU of one or more exercise devices.

16. An exercise device abuse-prevention control system according to claim 14, said predetermined threshold further comprising a secondary settable time period, said timer limiter being presettable by the administrator delineating a secondary maximum workout duration settable on said timer when the time of day measured on said clock reaches said secondary settable time period.

17. An exercise device abuse-prevention control system according to claim 12, said predetermined threshold further comprising a secondary number of exercise machines in use, said timer limiter being presettable by the administrator delineating a secondary maximum workout duration settable on said timer when the load detected on said load detector reaches said secondary number.

18. An exercise device abuse-prevention control system according to claim 12, wherein access to setting the predetermined threshold is restricted by an access restriction device.

19. An exercise device abuse-prevention control system according to claim 18, wherein said access restriction device comprises at least one of a physical key, a magnetic card key, a passcode enterable on the control panel of the exercise device, a wireless remote control device, or a password on a computer.

20. An exercise device abuse-prevention control system according to claim 12, wherein a plurality of exercise devices are networked, and said control system resides on a CPU remote from but in communication with the plurality of exercise devices.

21. An exercise device abuse-prevention control system according to claim 12, further comprising a warning message generator to inform at least one of i) a user during a workout session or ii) a third party when said predetermined threshold is reached or exceeded.

* * * * *